United States Patent [19]

Krichiver

[11] Patent Number: 4,651,499

[45] Date of Patent: Mar. 24, 1987

[54] NARROW FILM BAND ADAPTER

[75] Inventor: Joel Krichiver, Lenexa, Kans.

[73] Assignee: Robbie Manufacturing, Inc., Lenexa, Kans.

[21] Appl. No.: 613,303

[22] Filed: May 23, 1984

[51] Int. Cl.[4] ..... B65C 9/18

[52] U.S. Cl. ..... 53/137; 53/176; 242/68.4

[58] Field of Search ..... 53/137, 172, 176, 390; 156/554; 242/55.2, 68.4, 129.6

[56] References Cited

U.S. PATENT DOCUMENTS

| | | | |
|---|---|---|---|
| 1,926,245 | 9/1933 | Schmitt | 156/554 X |
| 2,082,114 | 6/1937 | Littlefield | 53/176 |
| 2,260,064 | 10/1941 | Stokec . | |
| 2,339,926 | 1/1944 | Hays | 242/68.4 |
| 2,469,366 | 5/1949 | Burbank . | |
| 2,814,328 | 11/1957 | Jess | 156/554 |
| 2,954,069 | 9/1960 | Lithio | 156/554 |
| 2,979,240 | 4/1961 | Liebeskind | 156/554 X |
| 3,030,244 | 4/1962 | Waite | 156/554 X |
| 3,057,571 | 10/1962 | Aaron | 242/68.4 X |
| 3,152,032 | 10/1964 | Waltz | 156/554 |
| 3,279,720 | 10/1966 | Garrett | 242/129.6 |
| 3,289,386 | 12/1966 | Farmer . | |
| 3,338,770 | 8/1967 | Billingsley | 156/554 X |
| 3,521,425 | 7/1970 | Palmer | 53/390 X |
| 3,584,808 | 6/1971 | Starles | 242/68.4 |
| 3,913,854 | 10/1975 | McClure | 242/68.4 |
| 4,425,182 | 1/1984 | Jones | 156/554 |

*Primary Examiner*—John Sipos

*Attorney, Agent, or Firm*—Litman, Day & McMahon

[57] ABSTRACT

A narrow film band adapter cooperates with a film wrapping stand to selectively position a narrow band roll of film, which bears advertising indicia, on a master roll of film for wrapping an article. The adapter has a horizontal support bar that is adjustably connected to the wrapping stand by a pair of connecting plates. A guide assembly is movable along a length of the support bar and receives the band roll. In one embodiment, the guide assembly includes two guide arms positioned on either side of the band roll and has respective apertures therein through which the bar extends. A fastener releasably holds the band roll between the guide arms and allows rotation of the band roll. Springs bias the guide assembly and band roll into operative contact with a portion of the master roll. In another embodiment, the guide assembly includes a pair of guide arms that are fixed in a generally vertical orientation extending above the bar. A spool and hub assembly receives the narrow band roll. In another embodiment, the guide assembly includes a band roll spool having a central bore therein through which the bar extends. A restrainer device is used to retain the spool and band roll in a selected position along the bar.

2 Claims, 18 Drawing Figures

NARROW FILM BAND ADAPTER

BACKGROUND OF THE INVENTION

This invention relates to apparatus for presenting plastic film for wrapping an article and particularly to such apparatus having adapters to join a narrow band of plastic film with a relatively wide film to be used in wrapping.

Food stuffs, particularly meat and poultry, are often wrapped in a package having an outer covering of transparent plastic film so that the food stuff can be viewed by the consumer. Merchandisers have long realized that it is desirable to provide selected advertising indicia associated with the wrapped article. Various methods of making labeled plastic packages have been devised, but have been found to be inefficient or unsatisfactory for use with a conventional manual film wrapping stand.

It has been found to be relatively expensive to print advertising indicia or the like onto a wide master roll of plastic film. A relatively narrow and thin band of film can, however, be printed at much lower cost.

Typically, most prior devices have utilized complex apparatus, including a series of tensioning rollers to force the narrow band into close adhesion contact with the master roll. Further, many of these systems rely on heat shrinking the plastic film about the wrapped article.

Various manual wrapping stands are in existence, and have been used for many years. However, the manual wrapping stands are not typically provided with an apparatus for carrying a narrow band roll of film. Thus, it is desirable to provide an adapter that can be attached to an existing film wrapping stand for carrying a narrow band roll of film. It is also desirable to ensure that the narrow film band is securely adhered to the master roll of film.

OBJECTS OF THE INVENTION

The principal objects of the present invention are: to provide a narrow film band adapter for attachment to an existing manual film wrapping stand; to provide such an adapter which presents the narrow band to a master roll of film for simultaneous wrapping of an article; to provide such an adapter having a guide assembly that is easily and quickly movable relative to a longitudinal axis of the master roll such that the narrow band can be presented to the master roll at various selected positions therealong; to provide such an adapter which can releasably hold the narrow band roll so that a number of such rolls may be interchanged; to provide such an adapter which provides means for ensuring that the narrow band is securely adhered to the master roll; to provide such an adapter which is relatively simple to use, ecomonical to manufacture and particularly well adapted for the proposed usage thereof.

Other objects and advantages of this invention will become apparent from the following description taken in conjunction with the accompanying drawings wherein are set forth, by way of illustration and example, certain embodiments of this invention.

SUMMARY OF THE INVENTION

A narrow film band adapter is provided for carrying a narrow band roll of plastic film and attaches to a film wrapping stand. The wrapping stand carries a master roll of film for use in wrapping articles, such as food stuffs and particularly meat and poultry items. The adapter includes a support apparatus, such as a bar, which is secured to the film wrapping stand so as to be selectively vertically adjustable relative thereto. The bar is generally horizontally aligned and extends parallel to a longitudinal axis of the master roll.

Generally, the master roll is mounted below a wrapping platform of the wrapping stand. The master roll is mounted on an axle assembly that allows free rotation of the master roll, as a free end of the roll is pulled by a user to feed film from the master roll. In particular, a web of the plastic film is pulled through an elongated slot in the wrapping platform by an operator. The adapter is preferably mounted below the platform near the master roll. Many existing wrapping stands are provided with means to receive two or more master rolls. For example, one roll may be of a certain width, while another roll is of a different width, such as twelve inches and fifteen inches. The various width rolls are used for wrapping different products. The adapter is positioned so that the narrow band roll can be reeved to feed with any of a plurality of master rolls on the wrapping stand.

The bar is connected to the film wrapping stand by a pair of connecting plates which extend from either end of the bar to an adjacent front support post of the wrapping stand. Preferably, the connecting plates are used in conjunction with respective auxiliary plates. The respective connecting and auxiliary plates are positioned on opposite sides of a respective support post and appropriate fasteners, such as bolts and wing nuts, extend between the plates and frictionally hold the plates and support bar in position relative to the support post.

The adapter also includes a guide assembly which holds the band roll. Preferably, the guide assembly is mounted on the bar and is movable along the length of the bar. Thus, the band roll can be positioned at any point across the wider master roll so that advertising indicia or the like on the band roll is exhibited at a selected site on the finished wrapped package.

Due to the properties of the plastic film commonly used in the industry, the film from the narrow band roll tends to snugly adhere to the master roll film without the use of external adhesives or heat shrinking processes. It has been found that thermoplastics such as polyvinyl chloride and polyvinylidene chloride work well for the intended porpose of the film. However, the expression "thermoplastic" is used in a general sense and is considered to encompass any suitable plastic or like material. Further, the adherance quality of the plastic film sometimes is referred to as contact adhesion and the wide film and the narrow band tend to be tacky or sticky relative to each other.

The guide assembly comprises at least one guide arm, preferably, a pair of guide arms. Each guide arm has an end with an aperture therein through which the bar extends for mounting. The apertures are sized such that the guide assembly is movable along a central section of the bar between the connecting plates. Each guide arm has a free end at which the band roll is releasably held by fastening means such as a spool and axle assembly.

The adapter is arranged such that the narrow band of film may be fed relative to the master roll so as to appear upon either side of the master roll film. Further, the band roll may be fed in conjunction with either a top master roll or a bottom master roll.

Tensioning means, such as springs, may be provided to maintain a portion of the band roll in operative contact with the master roll. The springs wrap around the bar and are connected at their respective ends to an associated guide arm.

Alternatively, the guide assembly may include a spool that receives the narrow band roll. The spool has a central bore therein through which the bar extends. The spool is movable along the length of the bar central section. Further, means are provided for releasably retaining the spool in a selected position along the bar central section.

Also alternatively, the guide assembly may include two vertical guide arms that project upwardly from the bar. The guide arms are movable along the bar central section, but do not move vertically. The guide arms may be connected by an integral lower plate, so as to form a U-shaped configuration. Notches are provided in upstanding free ends of the guide arms for receiving a hub and axle arrangement that rotatably holds the band roll.

Further alternatively, the support bars may be modified to extend from a single support post so that the guide assembly may be removed from the support bar without taking the plates of the support apparatus apart or removing the support bar therefrom.

The drawings constitute a part of this specification and include exemplary embodiments of the present invention and illustrate various objects and features thereof.

DETAILED DESCRIPTION OF THE INVENTION

Figure 2:
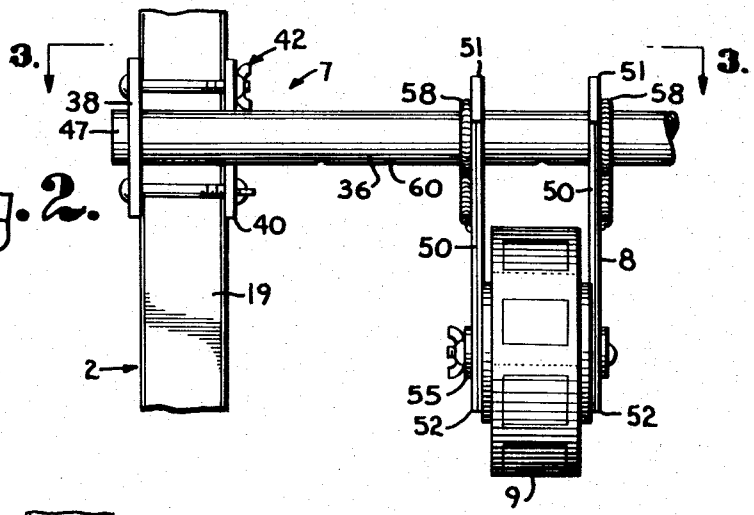
FIG. 2 is an enlarged, fragmentary front elevational view of the wrapping apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally indicates a narrow film band adapter. The adapter 1 is attached to a manual film wrapping stand 2 and is used in combination therewith. The wrapping stand 2 carries a master roll of plastic film 4. The plastic film from the master roll 4 is used in wrapping an article, such as food stuffs, and particularly meat and poultry items (not shown).

The adapter 1 includes a support apparatus 7 that supports a guide assembly 8. A narrow band roll of plastic film 9 is held by the guide assembly 8. The band roll 9 is positioned so that a portion or web 10 may be fed so as to join or adheredly mate with a web 11 unrolled from the master roll 4. The band roll web 10 is received on the master roll web 11 in snug superposed adhesion contact.

The film wrapping stand 2 includes a wrapping platform 15 suitable for supporting an article to be wrapped. The platform 15 has a longitudinal slot 16 through which the superposed webs 10 and 11 are threaded from beneath to above the platform 15 to present the webs 10 and 11 to a user. The platform 15 is supported by first and second front upright support posts 18 and 19 and a pair of rear upright support posts 20 and 21. The master roll 4 is rotatably supported by horizontal crossbraces 23 and 24 extending between posts 18 and 20 and posts 19 and 21 respectfully. The master roll 4 is rotatably supported by bearing members 25 and 26 on a central shaft 27.

As illustrated, an auxiliary master roll 29 is provided; this roll 29 may be of a different width than that associated with the master roll 4. The auxiliary master roll 29 is supported by auxiliary cross braces 30 and 31 and bearing members 32 and 33.

The band roll 9 is selectively positionable on the support apparatus 7 and alternatively may be positioned such that the band roll web 10 is reeved to feed onto the master roll 4 or the auxiliary master roll 29.

Figure 3:
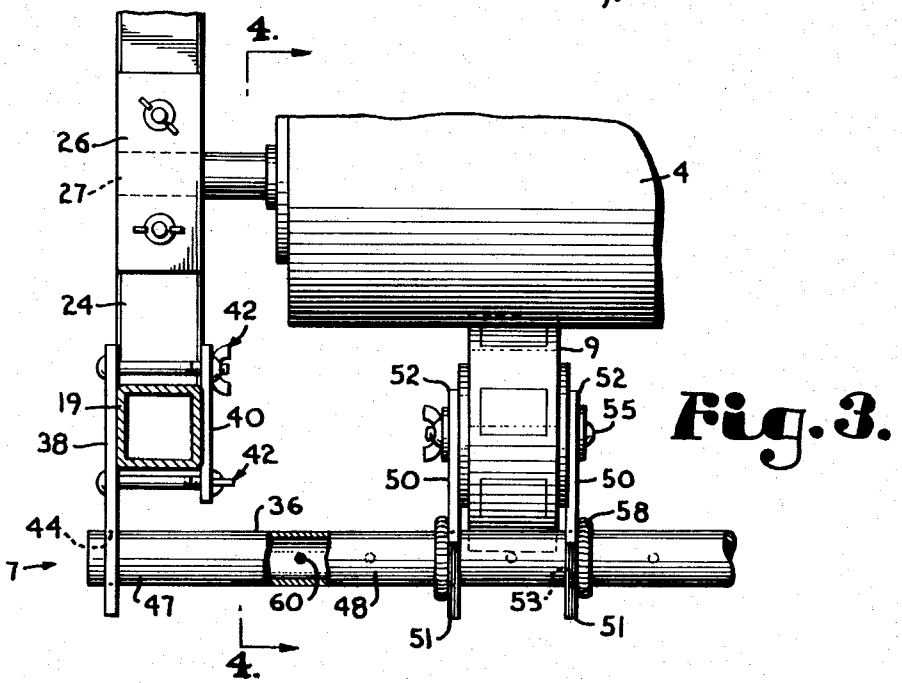
FIG. 3 is an enlarged, fragmentary cross-sectional view of the wrapping apparatus, taken along line 3—3, FIG. 2.
Figure 1:
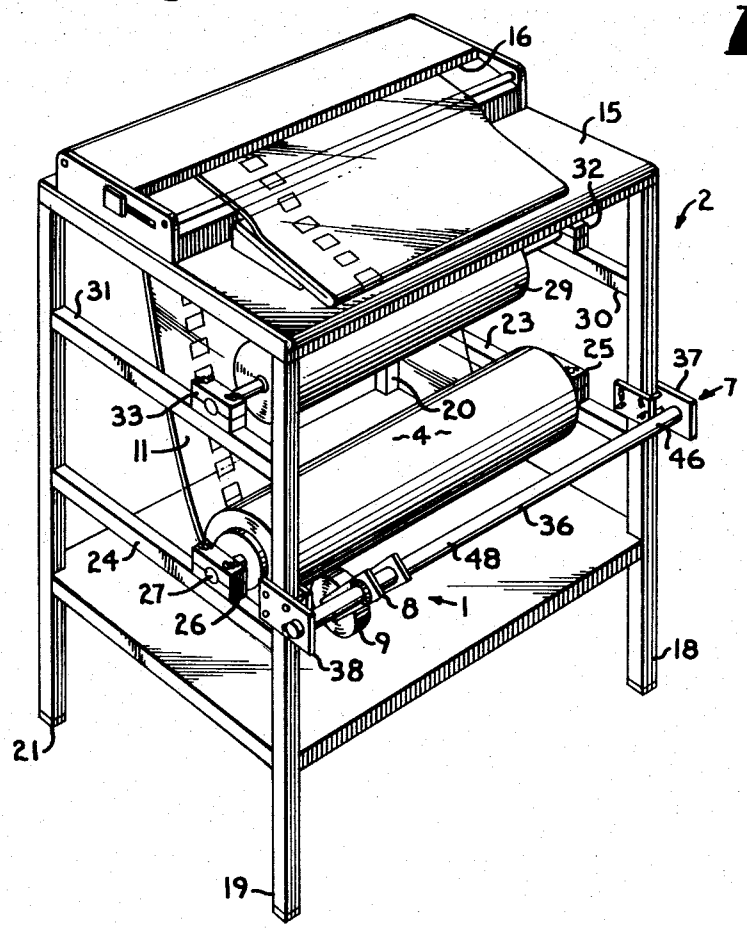
FIG. 1 is a perspective view of a wrapping apparatus comprising a narrow film band adapter and an associated film wrapping stand, embodying the present invention.

The support apparatus 7 includes a support bar 36, first and second connecting plates 37 and 38, and first and second auxiliary plates 39 and 40. As best seen in FIGS. 2 and 3, the connecting plates 37 and 38 and related auxiliary plates 39 and 40 are positioned on opposite sides of the first and second front posts 18 and 19, respectively. Fasteners, such as a plurality of bolt and wing nut fasteners 42, extend between the first connecting plate 37 and the first auxiliary plate 39, as well as between the second connecting plate 38 and second auxiliary plate 40. When tightened, the fasteners frictionally hold the connecting and auxiliary plates 37, 38, 39 and 40 on opposite sides of and in selective vertical locations along or relative to the respective support posts 18 and 19.

The connecting plates 37 and 38 each have an aperture 44 therein with a generally horizontally aligned axis. The bar 36 has a first end 46, a second end 47, and a central portion or section 48. The first and second ends 46 and 47 are axially aligned with and received in the first and second connecting plate apertures 44, respectively. The connecting plates 37 and 38 support the bar 36 in a spaced, generally horizontal juxtaposition that is parallel to a longitudinal axis of the master roll 4, as well as a longitudinal axis of the auxiliary master roll 29. Preferably, the bar 36 is fixedly positioned by shape relative to the apertures 44 or by suitable fasteners so that it does not freely rotate.

The guide assembly 8 includes a pair of guide arms 50 positioned on opposite sides of the narrow band roll 9. Each guide arm 50 has a supported or first end 51 and an opposite band roll 9 supporting or second end 52. Each arm first end 51 has an aperture 53 therein through which the bar 36 is slidably and snugly received. Preferably, the guide assemby 8 is movable along a length of the bar central section 48 so that the narrow band roll 9 is positionable at varying selected positions relative to the length of the master roll 4.

Fastening means, such as a hub and axle assembly 55, releasably hold the band roll 9 between the guide arms 50 in such a manner as to allow free rotation of the band roll 9 and simple removal and replacement of the narrow band roll 9 on the guide assembly 8.

Figures 4, 5, 6, 7, 8:
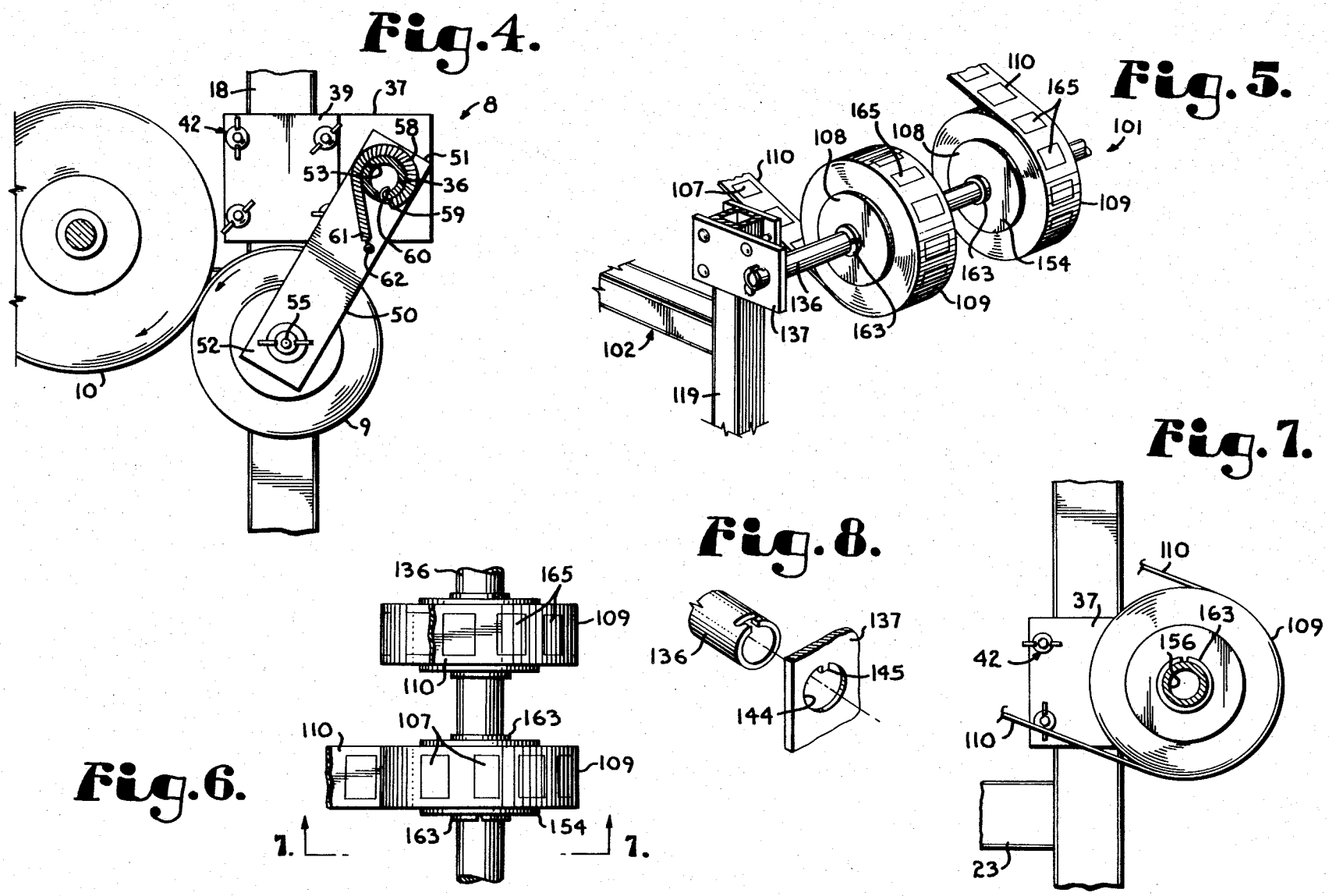
FIG. 4 is an enlarged, fragmentary cross-sectional view of the wrapping apparatus taken along line 4—4, FIG. 3.
FIG. 5 is a fragmentary perspective view of a first modified wrapping apparatus according to the present invention, showing dual narrow band rolls of film.
FIG. 6 is an enlarged, fragmentary top plan view of the first modified wrapping apparatus.
FIG. 7 is an enlarged, fragmentary cross-sectional view of the first modified wrapping apparatus, taken along line 7—7, FIG. 6.
FIG. 8 is an enlarged, fragmentary exploded view of the first modified wrapping apparatus showing a locking bar connection.

Tensioning means, such as a spring 58, are associated with the guide arms 50 for biasing and maintaining the band roll 9 in close operative contact with the master roll 4. One spring 58 is associated with each guide arm 50, as best illustrated in FIG. 4. Each spring 58 has a first end 59 connected to the bar 36, as by hooking into one of a plurality of openings 60 into the bar 36 and a second end 61 connected to the guide arm 50 at a location 62 thereon. The openings 60 are positioned along the length of the bar central section 48 and are spaced such that each spring first end 59 can be hooked into an opening 60 at a selected position along the bar 36. The second location 62 is positioned away from the guide arm first end 51 and toward the guide arm second end 52. The spring 58 wraps around a substantial portion of a circumference of the bar 36, extending from the opening 60 to the second location 62 so as to produce a lever arm relative to a longitudinal axis of the bar 36 and to tend to bias the guide arms 50 and an associated band roll 9 toward and into touching contact with the master roll 4.

As illustrated, the guide assembly 8 extends generally downwardly below the support apparatus 7, as best seen in FIG. 4. Thus, the spring 58 tends to bias the guide assembly 8 upwardly toward the master roll 4. It is envisioned that the guide assembly could be positioned so as to extend generally upwardly from the support apparatus 7 such that the spring 58 would tend to bias the guide assembly 8 downwardly toward the master roll 4. The tensioning means, specifically the spring 58, tend to ensure that the band roll web 10 is forced into snug operative contact with the master roll web 11.

In use, the guide assembly 8 is selectively positioned along the bar central section 48, and the spring first ends 59 are inserted into associated openings 60. The position of the guide assembly 8 is based on an operator's determination as to where he wishes the advertising indicia on the band web 10 to appear on the finished wrapped article. The band web 10 is manually placed into contact with the master roll 4, or the auxiliary master roll 29, and is fed or pulled along with the master roll web 11 through the slot 16 onto the working platform 15. The springs 58 tend to bias the guide assembly 8 and band roll 9 toward the master roll 4 to ensure that the band roll web 10 is forced into snug adherance to the unrolling film from the master roll 4. It is noted that, in the illustrated positioning of the parts of this embodiment, the band roll 9 is not positioned for use with the auxiliary master roll 29. However, the support apparatus 7 can be selectively moved vertically along the posts 18 and 19 so that the guide assembly 8 is positioned adjacent the auxiliary master roll 29, and the band roll web 10 can then be fed thereto.

FIRST ALTERNATIVE EMBODIMENT OF THE INVENTION

A first alternative embodiment of a narrow film band adapter 101 is illustrated in FIGS. 5 through 8, which adapter 101 is similar in certain features to adapter 1 of the embodiment of FIGS. 1 to 4. Numerals having similar last two digits are used with reference to the adapters 1 and 101 and to the stand 2 and a stand 102, for similar parts except that the numerals of the instant embodiment are preceded by the prefix "1". Thus, a front stand post 119 is generally analogous to the second front stand post 19 of the previous embodiment. In the example illustrated in FIGS. 5 through 8, a support apparatus 107 is generally analogous to the support apparatus 7 as initially described; however, a modified bar 136 and a modified connecting plate 137 are utilized. Each connecting plate 137 has an aperture 144 therein through which the bar 136 extends.

A locking arrangement is included and comprises an interlocking tab 145 of the connecting plate 137, which tab 145 extends into the aperture 144. The tab 145 interlocks with a T-shaped channel 149 defined in the bar 136. The tab 145 and channel 149 interferingly mate so as to releasably lock the bar 136 in place.

A guide assembly 108 includes a pair of spools 154 each of which holds a narrow band roll 109. Each spool 154 has a central bore 156 through which the bar 136 extends. Each band roll 109 is actually carried on a barrel portion of the spool 154, which barrel is not shown.

Position locking means for releasably retaining each spool 154 in a selected position along the bar 136 are included. For example, an O-ring like member 163 is placed on either side of the spool 154. The members 163 resiliently engage the bar 136 and tend to inhibit longitudinal movement of the spools 154 along the length of the bar 136.

As illustrated in FIGS. 5 and 6, each band roll 109 carries certain advertising indicia, as illustrated by blocks 165.

Also as illustrated in this first alternative embodiment, the support apparatus 117, specifically bar 136, is able to support or carry two or more guide assemblies 108. These dual guide assemblies 108 may be used to feed band webs 110 to either a master roll (not shown) or auxiliary roll (not shown) as desired. The other embodiments shown herein are also adapted to carry multiple guide assemblies and band rolls for quick change of advertising, position of advertising or change of association from one master roll to another.

In use, each guide assembly 108 of the first alternative embodiment is placed onto the bar 136 and the band roll web 10 is fed along with the master roll web 11. As shown, two of the first modified guide assemblies 108 are shown on the bar 136. As shown, the different narrow band webs 11 are usable with the master or auxiliary rolls respectively without further adjustment of the support apparatus 7.

Figure 9:
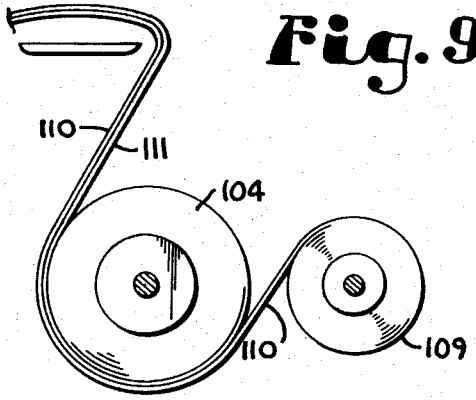
FIG. 9 is a partially schematic, enlarged and fragmentary side elevational view of the first modified wrapping apparatus showing a first alternative wrap feeding pattern.
Figure 10:
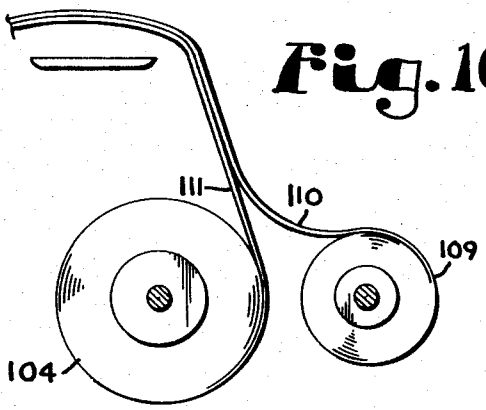
FIG. 10 is a partially schematic, enlarged and fragmentary view of the first modified wrapping apparatus showing a second alternative wrap feeding pattern.

FIGS. 9 and 10 schematically show two possible feeding patterns of the band roll web 110 and an associated master roll web 111. In FIG. 9, the band roll web 110 will appear on the inside of the master roll web 111 when wrapping, that is on the side toward the article to be wrapped. As shown in FIG. 10, the band roll web 110 will appear on the outside of the master roll web 111 when wrapping, that is on the side away from the article to be wrapped.

SECOND ALTERNATIVE EMBODIMENT OF THE INVENTION

Figure 11:
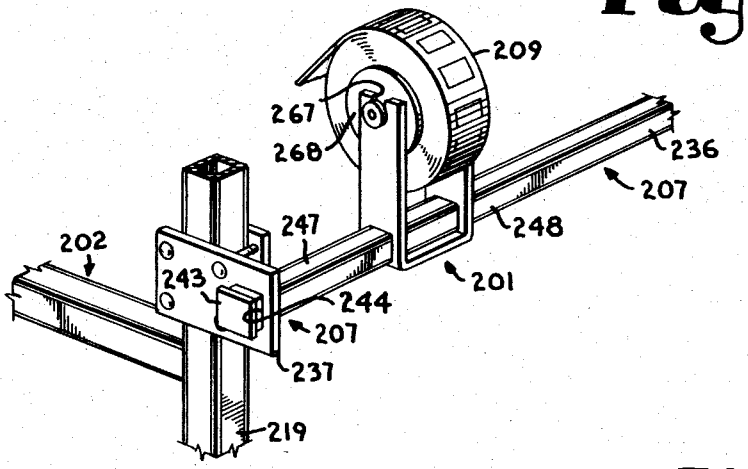
FIG. 11 is a fragmentary perspective view of a second modified wrapping apparatus according to the present invention.
Figure 12:
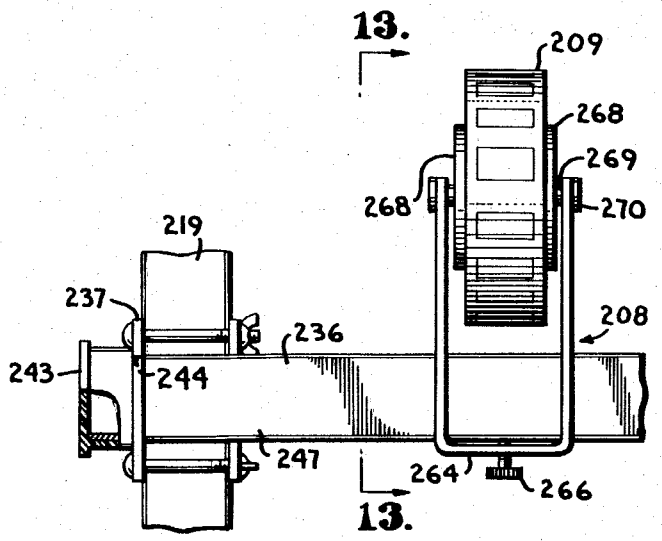
FIG. 12 is an enlarged, fragmentary front elevational view of the second modified wrapping apparatus.
Figure 13:
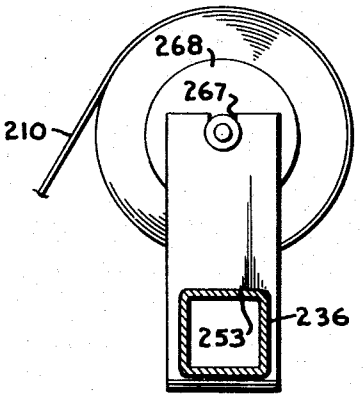
FIG. 13 is a cross-sectional view of the second modified wrapping apparatus taken along line 13—13 of FIG. 12.

A second alternative embodiment of a narrow film band adapter 201 is illustrated in FIGS. 11 through 13, which adapter 201 is similar in certain features to adapter 1 of the embodiment of FIGS. 1 to 4. Numerals having similar last two digits are used with reference to adapters 1 and 201 and to the stand 2 and a stand 202, for similar parts except that the numerals of the instant embodiment are preceded by the prefix "2". Thus, a front stand post 219 is generally analogous to the second front stand post 19 of the first embodiment. In the example illustrated in FIGS. 11 through 13, a support apparatus 207 is generally analogous to the support apparatus 7 as previously described, but comprises a support bar 236 having a squarish or rectangular cross section and connecting plates 237. The connecting plates 237 each have an aperture 244 therein through which the bar 236 extends. Each aperture 244 is generally square-shaped so as to snugly receive the bar 236.

The bar 236 has a first end (not shown), a second end 247 and a central section 248, and is provided with caps 243, which fit on either end of the bar 236 to prevent inadvertent passage of the bar 236 out of one of the apertures 244.

A guide assembly 208 preferably comprises a pair of guide arms 250 that are generally vertically positioned in transverse relation to the horizontal position of the bar 236. The guide arms 250 are movable horizontally along the bar 236. The guide arms 250 are fixedly positionable in a vertical or horizontal orientation.

Each guide arm 250 has a first or supported end 251 and a second end 252. Each arm proximal end 251 has an aperture 253 therethrough. The bar 236 extends snugly through these guide arm apertures 253 such that the guide arms 250 are held in a fixed position relative to the bar 236.

The first and second guide arms 253 are joined together at the respective first ends 251 thereof by an integral plate 264, and form a generally U-shaped configuration as best seen in FIG. 12. A set screw 266 extends through the plate 264 and frictionally contacts the bar 236 to retain the guide assembly 208 in a selected position along the bar 236.

Restraint means are provided for maintaining the guide arms 250 in the generally vertical orientation. As illustrated, the restraint means comprise the geometric configuration and cooperation between the square bar 236 and the square guide arm apertures 253, which interact to inhibit movement of the guide arms 250 relative to the bar 236.

Guide assembly holding means comprise notches 267 in the guide arm second ends 252, as well as a spool 268 and axle 269. The spool 268 holds a band roll 209 and has a central bore therethrough. The axle 269 extends through the spool bore and is received in the notches 267. The spool and axle arrangement allows the band roll 209 to freely rotate, while the axle and notch arrangement releasably retains the band roll 209. The axle 269 is further provided with flanges 270 which keep the band roll 209 generally centered between the guide arms 250 so that the spool 268 does not frictionally contact the guide arms 250.

In use, the guide assembly 208 is positioned along the bar central section 248, at a position to present the narrow roll 209 at a selected site on an associated master roll or auxiliary master roll (not shown), and the set screw 266 is tightened. The band roll web 10 is then fed to an associated master roll web (not shown). The notch 254 allows for quick changing of the band roll 209.

THIRD ALTERNATIVE EMBODIMENT OF THE INVENTION

Figure 14:
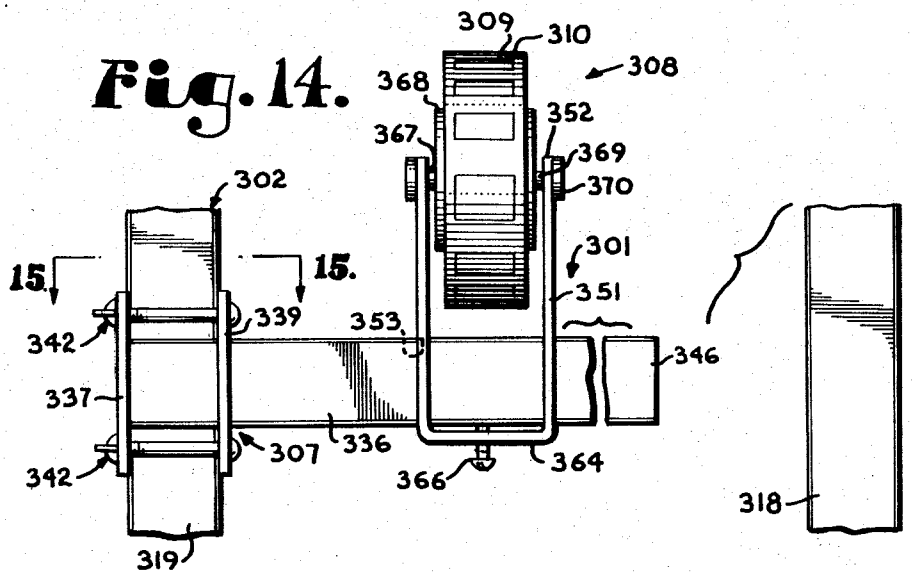
FIG. 14 is a fragmentary, front elevational view of a third modified wrapping apparatus according to the present invention.
Figure 15:
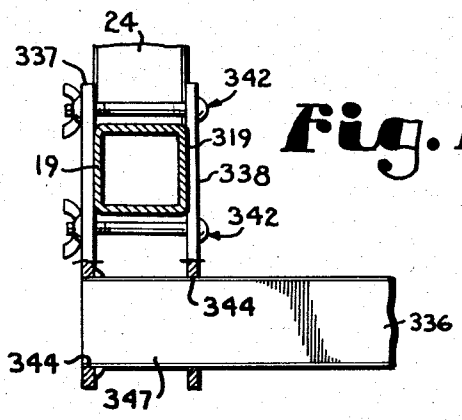
FIG. 15 is a cross-sectional view of the third modified wrapping apparatus taken along line 15—15 of FIG. 14.

A third alternative embodiment of a narrow film band adapter 301 is illustrated in FIGS. 14 and 15, which adapter 301 is similar to adapter 1 of FIGS. 1 to 4 described above. Numerals having similar last two digits are used with reference to adapters 1 and 301 and to the stand 2 and a stand 302, for similar parts except that the numerals of the instant embodiment are preceded by the prefix "3". Thus, first and second front stand posts 318 and 319 are generally analogous to the first and second front stand posts 18 and 19 of the embodiment illustrated in FIGS. 1 to 4. In the example illustrated in FIGS. 14 and 15, a support apparatus 307 is generally analogous to the support apparatus 7 as described above.

In general, a guide assembly 308 is similar to the guide assembly 208 described above.

The support apparatus 307 includes a support bar 336, a connecting plate 337 and an auxiliary plate 339. The connecting and auxiliary plates 337 and 339 are substantially similar and parallel, and are connected to the second post 319. A plurality of bolt and wing nut fasteners 342 frictionally hold the connecting and auxiliary plates 337 and 339 in place relative to the second post 319. The connecting and auxilary plates 337 and 339 each have an aperture 344 therein through which the bar 336 extends. The apertures 344 are generally square-shaped so as to receive similarly shaped bar 336.

The bar 336 has a first or free end 346, a second or supported end 347 and a central section 348. The bar supported end 347 is received through the plate apertures 344 and is preferably securely attached to the connecting plate 337, as by welding. The bar free end 346 extends toward the first post 318, but is spaced therefrom and does not contact the post 318.

The guide assembly 308 preferably comprises a pair of guide arms 350 that are generally perpendicularly, especially vertically, positioned in relation to the horizontal position of the bar 336. The guide arms 350 are movable horizontally along the bar central section 348 and are shown fixedly positioned in the vertical orientation. Each guide arm 350 has a first end 351 and a second end 352. The proximal end 351 has an aperture 353 therein through which the bar 336 extends.

First and second guide arms 353 are joined together at the respective first ends 351 thereof by an integral plate 364, and form a generally U-shaped configuration as seen in FIG. 14. A set screw 366 extends through the plate 364 and frictionally contacts the bar 336 to retain the guide assembly 308 in a selected position along the bar central section 348.

Restraint means are provided for maintaining the guide arms 350 in the generally vertical orientation. As illustrated, the restraint means comprise the geometric configuration of the cooperating parts of the square bar 336 and the square guide arm apertures 353, which interact to inhibit vertical movement of the guide arms 350.

Guide assembly holding means comprise essentially the same elements as disclosed in the second alternative embodiment, including notches 367 in the guide arm free ends 352, as well as a spool 368 and axle 369. The spool 368 holds a band roll 309 and has central bore (not shown) therein through which the axle 369 extends for receipt in the notches 367. The spool and axle arrangement allows the band roll 309 to freely rotate, while the axle and notch arrangement releasably retains the band roll 309. The axle 369 is further provided with flanges 370 which keep the band roll 309 generally centered between the guide arms 350 so that the spool 368 does not frictionally contact the guide arms 350.

In use, the guide assembly 308 is positioned along the bar central section 348 at a position to present the narrow band roll 309 at a selected site on a master roll (not shown) or auxiliary master roll (not shown), and the set screw 366 is tightened. A band roll web 310 is then fed to a master roll web (not shown). The notch 367 allows for quick changing of the band roll 309. Also, the guide assembly 308 may be easily removed from the bar 336 by sliding the guide assembly 308 to the bar free end 346 with the screw 366 loosened and slipping it therefrom.

FOURTH ALTERNATIVE EMBODIMENT OF THE INVENTION

Figure 17:
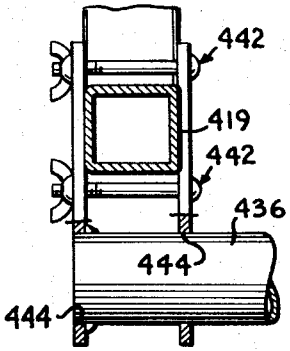
FIG. 17 is a cross-sectional view of the fourth modified wrapping apparatus taken along line 17—17 of FIG. 16.
Figure 18:
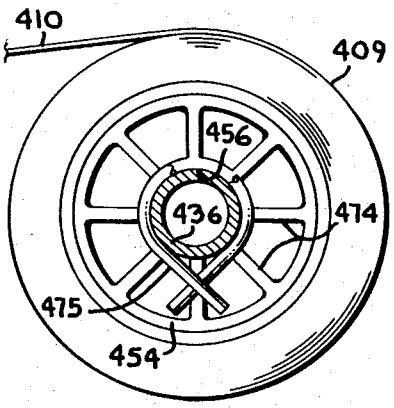
FIG. 18 is a cross-sectional view of the fourth modified wrapping apparatus taken along line 18—18 of FIG. 16.
Figure 16:
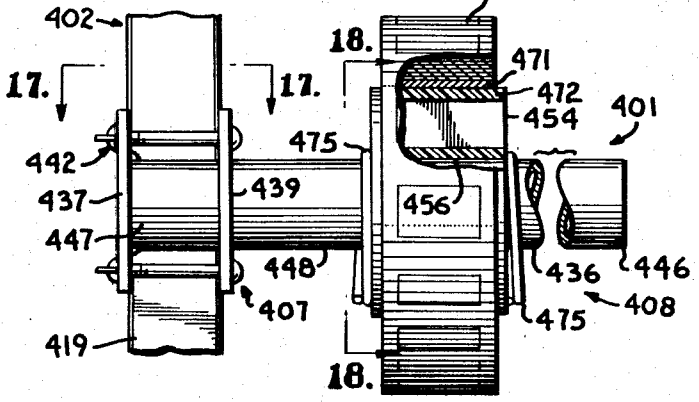
FIG. 16 is a fragmentary, front elevational view of a fourth modified wrapping apparatus according to the present invention with portions broken away to show detail thereof.

A fourth alternative embodiment of a narrow film band adapter 401 is illustrated in FIGS. 16 through 18, which adapter 401 is similar to adapter 1 of FIGS. 1 to 4 described hereinabove. Numerals having similar last two digits are used with reference to the adapters 1 and 401 and to the stand 2 and a stand 402 of the present embodiment, for similar parts except that the numerals of the instant embodiment are preceded by the prefix "4". Thus, a front stand post 419 is generally analogous to the second front stand post 19 of the first embodiment. In the example illustrated in FIGS. 16 through 18, a support apparatus 407 is generally analogous to the support apparatus 7 as described above. Also, a guide assembly 408 is similar to the guide assembly 108 of the first alternative embodiment, except as noted.

The support apparatus 407 comprises a bar 436, a connecting plate 437 and an auxiliary plate 439. The connecting and auxiliary plates 437 and 439 are connected to the post 419 and are held thereon by a plurality of bolt and wing nut fasteners 442. When tightened, the bolt and wing nut fasteners 442 frictionally hold the connecting and auxiliary plates 437 and 438 in fixed position relative to the support posts 419, but allow sliding therealong when loosened. Each of the connecting and auxiliary plates 437 and 439 has an aperture 444 therein through which the bar 436 extends. The bar 436 includes a first or free end 446, a second opposite or supported end 447, and a central section 448. The bar second end 447 is received in the connecting plate aperture 444, and preferably fixedly held in the connecting plate aperture 444, as by welding.

The guide assembly 408 includes a spool 454, which holds a narrow band roll 409, which unrolls into a web 410. The spool 454 has a central bore 456 through which the bar 436 extends. The band roll 409 has an inner cardboard core 471 which frictionally contacts a barrel portion 472 of the spool 454. The spool 454 is typically manufactured of a hard plastic material, and includes a plurality of spokes 474 which extend from the center of the spool 454 to the barrel portion 472 and keep the barrel portion 472 spaced from the central bore 456.

Means for releasably retaining the spool 454 in a selected position along the bar central section 448 are included. For example, clamps 475 can be positioned on either side of the spool 454. The clamps 475 resiliently engage the bar 436 and tend to inhibit longitudinal movement of the spool 454 along the length of the central section 448.

It is noted that the spool 454 is interchangeable with the third alternative embodiment spool 368, such that narrow band rolls carried on either of the spools 368 or 454 may be interchanged to fit the needs of the operator.

In use, the guide assembly 408 of the fourth alternative embodiment is placed onto the bar 436 and the band roll web 410 is fed along with the web of the master roll (not shown). The bar 436 is sufficiently long to ensure that the narrow roll web 410 can be placed at any desired position along the master roll, but is short enough that the narrow band roll 409 with spool 454 can be removed from the bar free end 446 for easy changing without contacting a front support post (not shown) opposite the post 419.

It is to be understood that while certain forms of the present invention have been illustrated and described herein, it is not to be limited to the specific forms or arrangement of parts described and shown.

What is claimed and desired to be secured by Letters Patent is as follows:

1. A narrow film band adapter for attachment to a film wrapping stand; said adapter comprising:
   (a) a noncircular bar having a first end, a second end and a central section;
   (b) connecting means for connecting said bar to the film wrapping stand; and
   (c) a guide assembly for receiving a narrow band roll of film; said guide assembly comprising:
      (1) first and second guide arms being positionable on opposite sides of the narrow band roll, each of said guide arms having a first end and a second end, each of said second ends extending away from said bar; said guide arms being operatively connected to said bar along said central section thereof and generally held in a selected position relative to said bar; said first and second guide arms being joined at respective said first ends by an integral plate extending therebetween; said integral first guide arm, plate, and second guide arm forming a generally U-shaped configuration;

(2) said first and second guide arm first ends each defining a noncircular aperture therethrough; said bar extending through said first and second guide arm apertures;

(3) restraint means for maintaining said first and second guide arms in the selected position thereof relative to said bar;

(4) said guide arms being generally fixed in a vertical orientation relative to said bar; and said guide arms bieng movable horizontally along said bar central section while fixedly positioned in the vertical orientation;

(5) said first and second guide arm second ends having notches therein for holding the band roll, while allowing the band roll to rotate; and (6) a spool and hub assemby received in said notches; said spool being adapted to hold the band roll and having a central bore therethrough; said hub extending through said spool central bore and contacting each of said first and second notches, whereby said spool and the band roll are releasably held in position.

2. The narrow film band adapter as set forth in claim 1 wherein:

(a) said bar is connected to the film wrapping stand at said bar second end; and, (b) said bar first end is a free end, such that said guide assembly is removable from said support bar at said free first end thereof without removal of said support bar from said stand.

* * * * *